US006465960B2

(12) United States Patent
Van Duivendijk et al.

(10) Patent No.: US 6,465,960 B2
(45) Date of Patent: Oct. 15, 2002

(54) CAPPED ELECTRIC LAMP AND LOW-PRESSURE MERCURY-VAPOR DISCHARGE LAMP

(75) Inventors: Pieter Dirk Melis Van Duivendijk, Roosendaal (NL); Frank Gerardus Cornelis De Bot, Roosendaal (NL); Antonius Johannes Spaapen, Roosendaal (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/790,184

(22) Filed: Feb. 22, 2001

(65) Prior Publication Data

US 2002/0030448 A1 Mar. 14, 2002

(30) Foreign Application Priority Data

Feb. 24, 2000 (EP) ..... 00200647

(51) Int. Cl.[7] ..... F21S 3/00
(52) U.S. Cl. ..... 315/56; 313/318.02; 313/318.08
(58) Field of Search ..... 313/318.02, 318.05, 313/318.08, 623, 624; 315/46, 48, 49, 56; 439/612, 619

(56) References Cited

U.S. PATENT DOCUMENTS 4,322,783 A * 3/1982 Chappell et al. ..... 313/318
4,568,854 A * 2/1986 Westlund, Jr. et al. ..... 313/318
6,002,200 A * 12/1999 Keim et al. ..... 313/318.02

FOREIGN PATENT DOCUMENTS

GB 692290 A 6/1953

* cited by examiner

*Primary Examiner*—David Vu
*Assistant Examiner*—Wilson Lee
(74) *Attorney, Agent, or Firm*—Frank Keegan

(57) ABSTRACT

An electric lamp has a cap, which is secured to a light-transmitting lamp vessel having an electric element. The lamp cap has a projecting contact pin. An electric conductor is connected to the electric element and the contact pin. The contact pin is unilaterally deformed in an inward direction so as to form an indentation for fixing the electric conductor. The electric conductor in the contact pin does not extend substantially beyond a boundary of the indentation. The indentation has a pinch portion. The pinch portion deepens at an angle a with respect to the axis, where $25° \leqq \alpha \leqq 45°$. In addition, the indentation has a press portion for fixing the electric conductor in the contact pin.

15 Claims, 3 Drawing Sheets

CAPPED ELECTRIC LAMP AND LOW-PRESSURE MERCURY-VAPOR DISCHARGE LAMP

FIELD OF THE INVENTION

The invention relates to a capped electric lamp comprising a light-transmitting lamp vessel accommodating an electrical element, a lamp cap provided with a projecting contact pin having an axis, which lamp cap is secured to the lamp vessel, an electric conductor which is connected to the electrical element and to the contact pin, an indentation being formed in the contact pin to fix the electric conductor.

The invention also relates to a low-pressure mercury vapor discharge lamp.

BACKGROUND OF THE INVENTION

Such an electric lamp is disclosed in GB-A 0 692 290. In the known lamp, wedge-shaped indentations are situated on either side of the contact pin and opposite each other, which indentations are used to shrink the contact pin so as to contact the electric conductor.

The known capped electric lamp is a fluorescent lamp having two contact pins at the lamp cap. In a fluorescent lamp, mercury is the primary component for (efficiently) generating ultraviolet (UV) light. An inner wall of the discharge vessel may be coated with a luminescent layer comprising a luminescent material for converting UV to other wavelengths, for example to UV-B and UV-A for tanning purposes, or to visible radiation for general illumination purposes. The discharge vessel of said fluorescent lamps is generally tubular with a circular cross-section and includes both elongated and compact embodiments.

A drawback of the known capped electric lamp resides in that, during the manufacture of the lamp, more particularly when the contact pin is provided with the indentation, the end portion of the electric conductor projecting from the contact pin is subjected to a pulling force to preclude that the electric conductor in the lamp cap or in the lamp vessel electrically contacts a further electric conductor which has been passed through an adjacent contact pin. After fixing the electric conductor in the contact pin, said projecting end portion of the electric conductor must be removed. This is achieved by cutting and/or filing. This constitutes a drawback because additional safety measures must be taken to ensure that these operations are carried out in a safe and clean manner. In the case of the much used tubular fluorescent lamps comprising two such lamp caps, which are each provided with two contact pins, said drawback increases accordingly.

SUMMARY OF THE INVENTION

It is an object of the invention to provide a capped electric lamp of the type mentioned in the opening paragraph, wherein said drawback is obviated.

In accordance with the invention, this object is achieved in that the electric conductor in the contact pin does not extend beyond a boundary of the indentation that is furthest removed from the lamp cap.

The indentation in the contact pin is formed in the course of the manufacture of the electric lamp by an inward deformation of the contact pin. By locally indenting the contact pin, the electric conductor is fixed in the contact pin. As a result of said indentation, the electric conductor is weakened near the boundary of the indentation to such extent that, upon exerting a pulling force on the end portion of the electric conductor projecting from the contact pin, the electric conductor breaks off at a predetermined location. By providing the electric conductor with a predetermined weakened portion, the electric conductor breaks off near the boundary of the indentation. After breaking off the electric conductor, (the end portion of) the electric conductor no longer projects from the contact pin. As a result, cutting and/or filing of the end portion of the electric conductor projecting from the contact pin after fixing the electric conductor has become superfluous.

It is to be noted that the exertion of a pulling force on (the end portion of) the electric conductor can alternatively be carried out, after fixing the electric conductor in the contact pin, by suitably twisting the end portion of the electric conductor projecting from the contact pin. Experiments have further shown that upon pulling loose the end portion of the electric conductor, the fixation resulting from the indentation of the contact pin is sufficiently strong, so that the end portion of the electric conductor can be pulled loose independent of the fixation of the electric conductor.

Indenting the contact pin to weaken the electric conductor preferably takes place unilaterally. The indentation is generally formed in the contact pin by means of a so-called pinching pin, which is pressed against the contact pin in a direction transverse to the axis, causing the contact pin to be deformed in an inward direction.

A preferred embodiment of the capped electric lamp in accordance with the invention is characterized in that the indentation has a pinch portion near the boundary, which serves to weaken the electric conductor during the manufacture of the electric lamp. The term "pinch portion" is to be taken to mean in the description and the claims of the invention under consideration that, during the indentation process, the contact pin is locally pressed deeper into the electric conductor and at a more acute angle. This pinch portion does not "cut" the electric conductor but causes the electric conductor to be weakened such that upon exerting a pulling force on the end portion of the electric conductor, said electric conductor breaks off at a predetermined location. The use of such a pinch portion has the advantage that the electric conductor remains fixed in the contact pin during and after the removal of the projecting end portion of the electric conductor. Exerting a pulling force on the projecting end portion of the electric conductor, after indentation of the contact pin, does not cause the fixation of the electric conductor in the contact pin to be weakened such that the electric conductor is no longer fixed in the contact pin.

In a particularly preferred embodiment of the capped electric lamp in accordance with the invention, the pinch portion deepens in the direction of the front boundary at an angle ranging from $10° \leqq \alpha \leqq 45°$, wherein the angle $\alpha$ is measured with respect to the axis. To fix the electric conductor, use is made of a so-called pinching pin. At an angle $\alpha < 10°$, the weakening of the electric conductor during the provision of the indentation is insufficient to cause the end portion of the electric conductor to become detached from the electric conductor when a pulling force is applied, while at the same time the electric conductor remains fixed in the contact pin. Furthermore, at an angle $\alpha < 10°$, the pulling force necessary to remove the end portion of the electric conductor is so large that the fixation of the electric conductor in the contact pin is annihilated almost completely. At an angle $\alpha > 45°$, aging of the pinching pin occurs rapidly due to the fact that the pinch portion breaks off readily owing to too high a pressure on said pinch portion.

Preferably, the pinch portion deepens at an angle in the range from $25° \leqq \alpha \leqq 35°$. Experiments have shown that the use of a pinching pin having such a pinch portion enables the end portion of the electric conductor to be removed while preserving the fixation.

The indentation 15 further comprises a press portion for fixing the electric conductor. The combination of the press portion and the pinch portion causes a synergetic effect to be obtained. On the one hand, the pinch portion weakens the electric conductor upon indenting the contact pin and, on the other hand, the press portion causes the electric conductor to be fixed in the contact pin such that the end portion of the electric conductor can be readily pulled loose without the fixation of the electric conductor being substantially reduced. To this end, the length of the press portion in the fixation area is preferably chosen to be such that upon pulling the end portion of the electric conductor from the contact pin, the electric conductor remains fixed in the contact pin.

It is particularly favorable if the contact pin 4 has only one indentation 15. This enables the pinch portion and the press portion to be provided in a single operation.

The measure in accordance with the invention can particularly suitably be applied to low-pressure mercury vapor discharge lamps comprising a capped electric lamp in accordance with the invention wherein the lamp vessel encloses a discharge space provided with a filling of mercury and an inert gas in a gastight manner, and wherein the electric element comprises an electrode arranged in the discharge space for maintaining a discharge in said discharge space.

These and other aspects of the invention will be apparent from and elucidated with reference to the embodiment(s) described hereinafter.

DETAILED DESCRIPTION OF THE PREFERRED EMBODIMENTS

Figure 1:
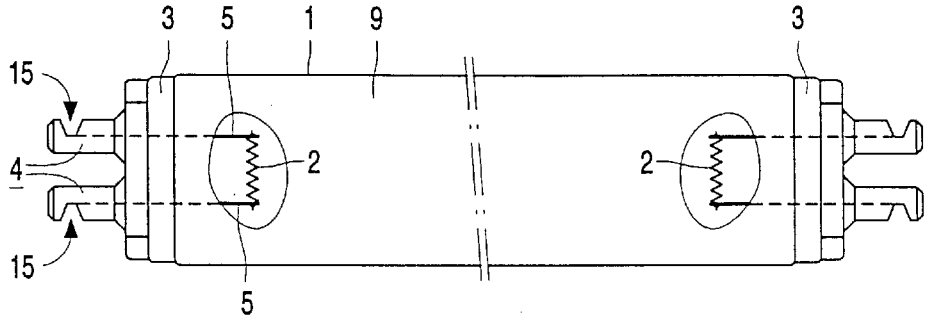
FIG. 1 is a side view of a capped electric lamp in accordance with the invention.

The Figures are purely diagrammatic and not drawn to scale. Particularly for clarity, some dimensions are exaggerated strongly. In the drawings, like reference numerals refer to like parts whenever possible.

In FIG. 1, the capped electric lamp comprises a light-transmitting lamp vessel 1 accommodating an electric element 2. A lamp cap 3 provided with a projecting contact pin 4 is secured to the lamp vessel 1. An electric conductor 5 connects the electric element 2 to the contact pin 4. The contact pin 4 is provided with an indentation 15 for fixing the electric conductor 5.

The lamp shown comprises two identical lamp caps 3, which each have two contact pins 4, said lamp caps each being connected by a respective conductor 5 to the electric element 2. The lamp shown is a low-pressure mercury vapor discharge lamp, wherein the lamp vessel 1 encloses a discharge space 9 containing a filling of mercury and an inert gas in a gastight manner. The lamp vessel 1 is coated with a luminescent material (not shown in FIG. 1). The discharge space 9 accommodates two electrodes, which serve as the electric element 2, and which can be heated by current passage in order to ignite the lamp.

Figure 2:
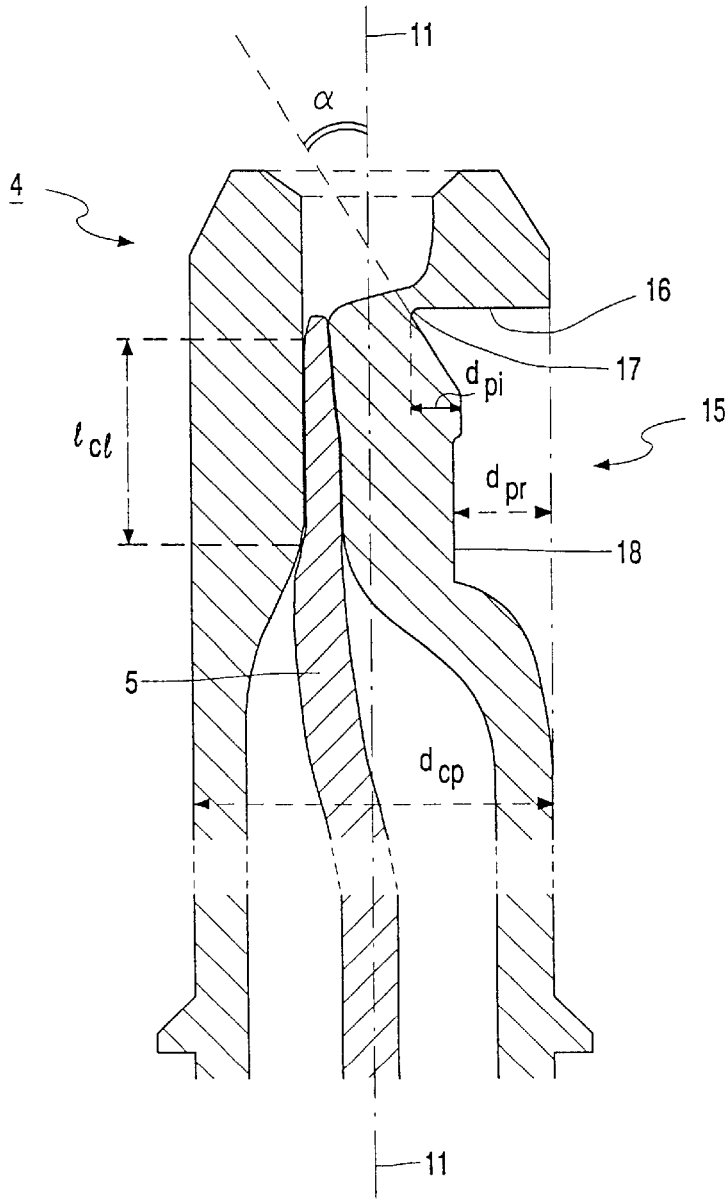
FIG. 2 is a cross-sectional view of a contact pin of the capped electric lamp in accordance with the invention.

FIG. 2 is a cross-sectional view of a detail of the capped electric lamp in accordance with the invention shown in FIG. 1. In particular, FIG. 2 diagrammatically shows a contact pin 4 with an axis 11, the electric conductor 5 being fixed. The contact pin 4 is unilaterally deformed in an inward direction, an indentation 15 being formed in the contact pin 4 (see FIGS. 3A and 3B). The indentation 15 has a boundary 16 at a side facing away from the lamp cap 3. In the example shown in FIG. 2, the boundary is indicated as a plane extending transversely to the axis 11. In an alternative embodiment, the boundary encloses an angle with the axis 11. In accordance with the measure of the invention, the electric conductor 5 in the contact pin 4 does not extend beyond the boundary 16 of the indentation 15.

The indentation 15 comprises a pinch portion 17 and a press portion 18. Near the boundary 16, the indentation has a pinch portion 17 for weakening the electric conductor 5 in the course of the manufacture of the electric lamp. In the example shown in FIG. 2, said pinch portion 17 deepens in the direction of the front boundary 16 at an angle $\alpha$, said angle $\alpha$ being measured with respect to the axis 11. Preferably, the angle $\alpha$ lies in the range from $25° < \alpha < 35°$. A pinch portion 17 that deepens at an angle $\alpha \approx 30°$ is particularly favorable. Preferably, the ratio of the depth $d_{pi}$ of the pinch portion 17 to the diameter $d_{cp}$ of the contact pin 4 meets the relation:

$$0.05 \leq \frac{d_{pi}}{d_{cp}} \leq 0.15$$

The indentation 15 further comprises a press portion 18 for fixing the electric conductor 5. The press portion 18 makes sure that the electric conductor 5 is appropriately fixed in the contact pin 4, while the pinch portion 17 so weakens the electric conductor 5 when it provides the contact pin 4 with an indentation that the end portion of the electric conductor can be readily pulled loose.

Figure 3A:
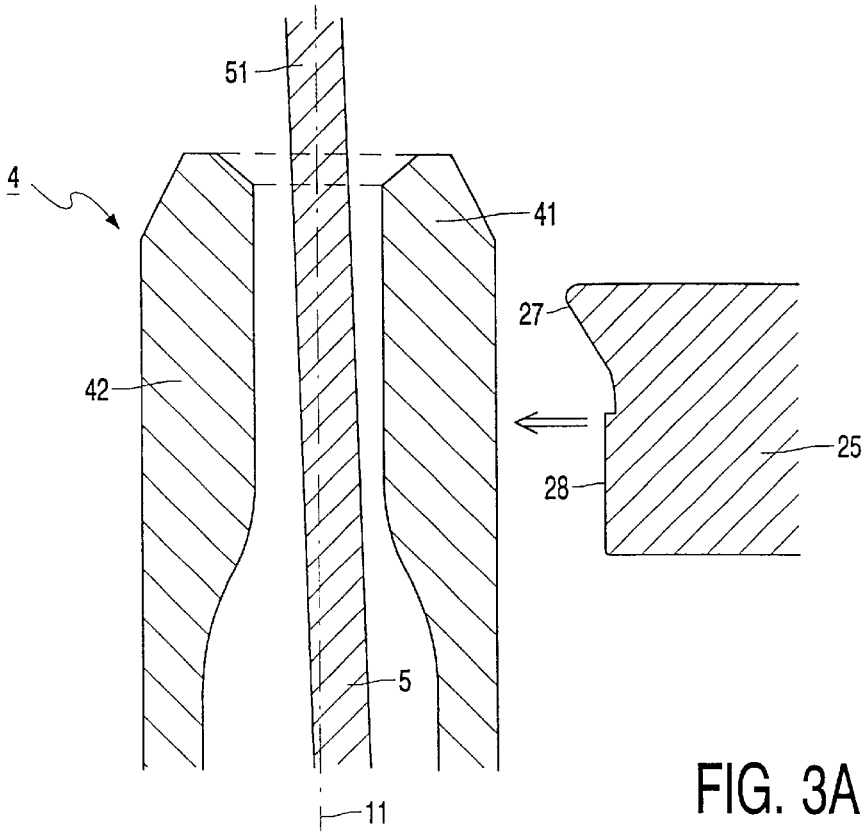
FIG. 3A is a cross-sectional view of the contact pin before the indentation is provided.

FIG. 3A is a diagrammatic, cross-sectional view of the contact pin 4 before the indentation is provided. The contact pin 4 has a thickened end portion, which bears reference numerals 41 and 42 in this cross-sectional view. The electric conductor 5 has an end portion 51, which projects from the contact pin 4. Furthermore, a so-called pinching pin 25 is embodied so as to comprise a so-called pinch portion 27 and a press portion 28. The pinching pin 25 is moved towards the contact pin 4 in the direction indicated by means of the arrow shown in FIG. 3A.

Figure 3B:
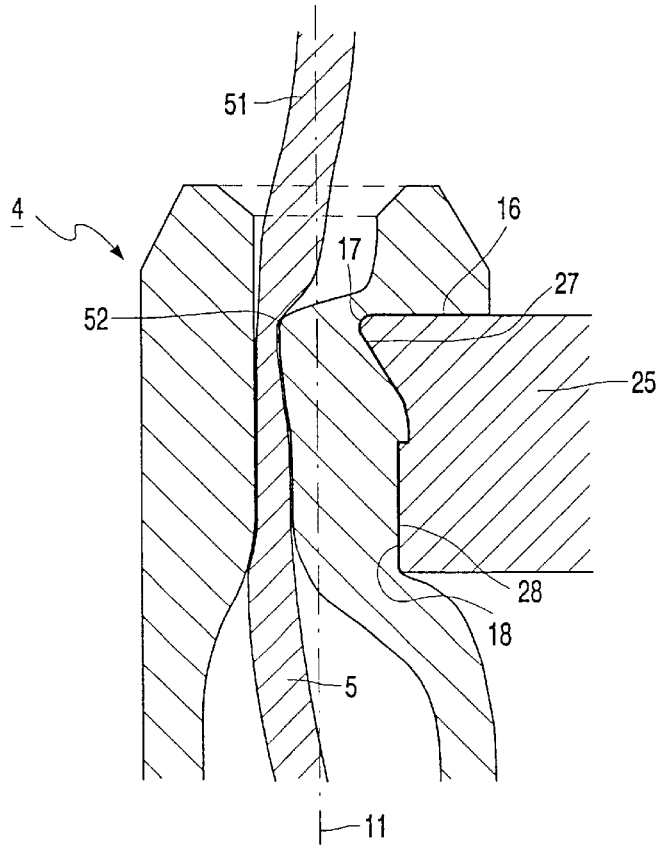
FIG. 3B is a cross-sectional view of the contact pin shown in FIG. 3A during the provision of the indentation.

FIG. 3B is a diagrammatic, cross-sectional view of the contact pin of FIG. 3A during the deformation of the contact pin 4 for providing the indentation. The pinch portion 27 and the pressing portion 28 of the pinching pin 25 are pressed into the thickened end portion 41 of the contact pin, thereby causing an inward, unilateral deformation of the thickened end portion 41. The deformation of the contact pin 4 causes material (metal) of the electric conductor 5 to flow out, which is shown in FIG. 3B in that the electric conductor 5 becomes thinner at the location of the indentation 15. The pinching portion 27 of the pinching pin 25 shapes the pinch portion 17 in the thickened end portion 41, and the pressing portion 28 of the pinching pin 25 corresponds to the press portion 18 in the thickened end portion 41 of the contact pin 4. Under the influence of the pinching portion 27 of the thickened end portion 41, the electric conductor 5 is weakened at the location of the maximum indentation, referenced 52 in FIG. 3B, to such extent that a pulling force exerted on the end portion 51 of the electric conductor 5 causes this end portion to break off near the boundary 16 of the indentation 15. After the end portion 51 has been detached from the electric conductor 5, the situation as shown in FIG. 2 is obtained.

Pin-pinching experiments have shown that the pinch depth is a measure of the strength of the pinch joint. It has been found that a favorable ratio of the depth $d_{pr}$ of the press portion to the diameter $d_{cp}$ of the contact pin meets the relation:

$$0.2 \leq \frac{d_{pr}}{d_{cp}} \leq 0.4$$

Figure 4:
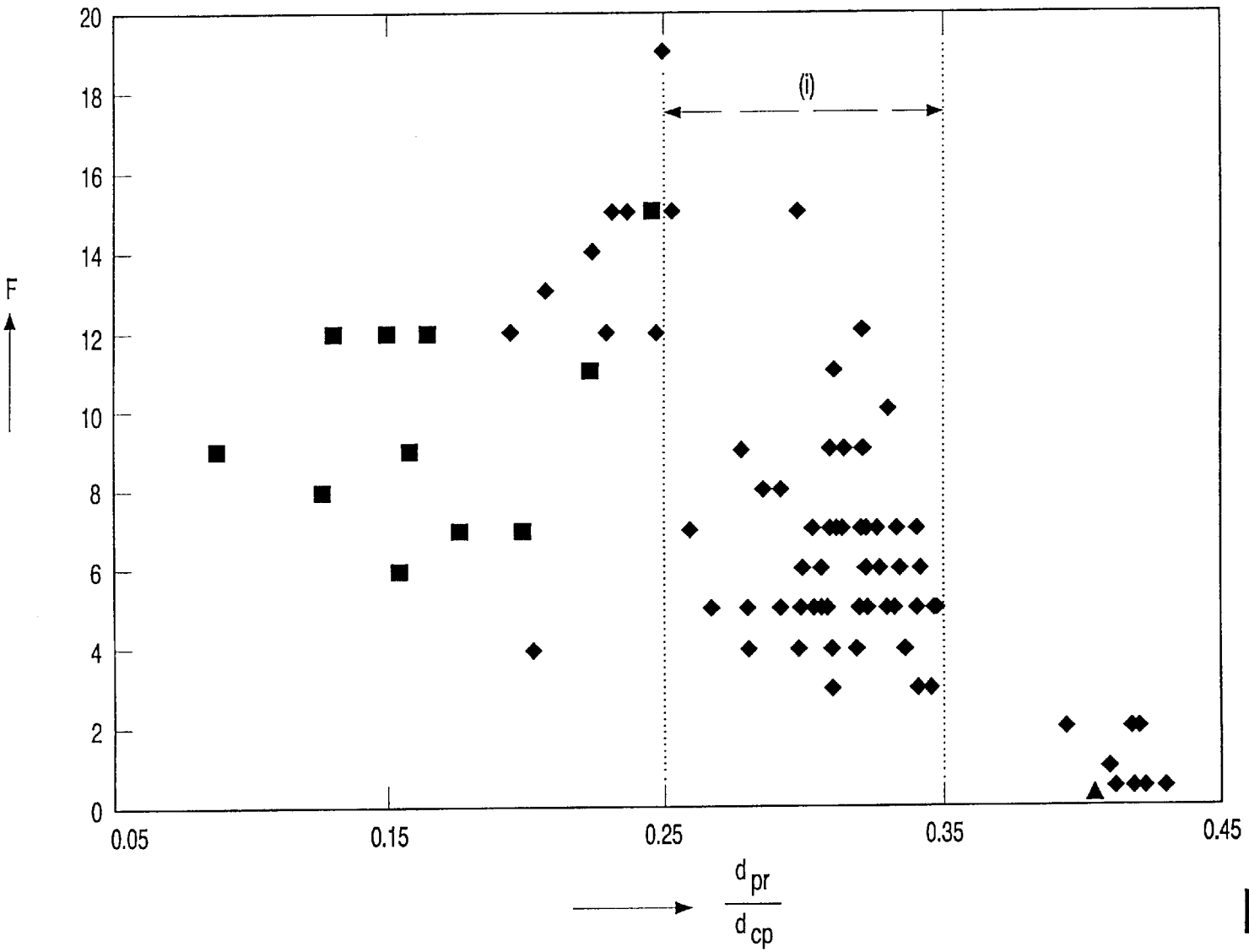
FIG. 4 shows the pulling force as a function of the relative depth dimension of the indentation.

In FIG. 4, the pulling force F (in N) is shown as a function of the relative depth $d_{pr}/d_{cp}$ of the indentation. The pulling force F is the force that is necessary to pull the end portion 51 of the electric conductor 5 loose from the contact pin 4 (see FIG. 3B). The relative depth $d_{pr}/d_{cp}$ is also referred to as the pin-pinching depth. In FIG. 4, three kinds of symbols are used:

(a) open squares: after pulling loose the end portion 51 of the electric conductor 5, said electric conductor 5 can be moved in the contact pin 4;

(b) filled triangle: deformation of the contact pin has caused the electric conductor 5 to become detached on the side of the electric conductor 5 facing the lamp vessel 1;

(c) filled diamonds: the end portion 51 of the electric conductor 5 breaks off and can be readily removed from the contact pin 4.

In connection with this, broadly three ranges can be distinguished in FIG. 4:

(a) too small a pin-pinching depth: $d_{pr}/d_{cp}<0.2$. At a pin-pinching depth below the above-mentioned limit, the end portion 51 of the electric conductor 5 does not break off, but instead the electric conductor 5 moves in the contact pin 4.

(b) too large a pin-pinching depth: $d_{pr}/d_{cp}>0.4$. At a pin-pinching depth above said limit, the end portion 51 of the electric conductor 5 can be readily removed from the contact pin 4. However, during the deformation, the indentation formed in the electric conductor on the side facing the lamp vessel 1 is too deep, as a result of which the electric conductor 5 may become detached on the lamp side.

(c) a favorable pin-pinching depth: $0.2 \leqq d_{pr}/d_{cp} \leqq 0.4$. At a pin-pinching depth in between said limits, the superfluous end portion 51 of the electric conductor 5 can be readily pulled loose and removed. The fracture in the electric conductor 5 occurs near the spot where the indentation 15 is maximal, and which is referenced 52 in FIG. 3B. The electric conductor 5 is sufficiently secured in the indentation 15 and there is no risk that the electric conductor 5 will be pulled loose on the side facing the lamp vessel 1.

FIG. 4 shows, by means of vertical dotted lines, a very favorable range for the pin-pinching depth. In the range indicated by means of (i), the pin-pinching depth $d_{pr}/d_{cp}$ meets the relation:

$$0.25 \leq \frac{d_{pr}}{d_{cp}} \leq 0.35$$

Preferably, the length $l_{cl}$ of the fixation of the electric conductor 5 in the contact pin 4 is at least 0.75 mm (see FIG. 2).

It will be clear that, within the scope of the invention, many variations are possible to those skilled in the art.

The scope of protection of the invention is not limited to the examples described herein. The invention is embodied in each novel characteristic and each combination of characteristics. Reference numerals in the claims do not limit the scope of the protection thereof. The use of the verb "to comprise" and its conjugations does not exclude the presence of elements other than those mentioned in the claims. The use of the article "a" or "an" in front of an element does not exclude the presence of a plurality of such elements.

What is claimed is:

1. A capped electric lamp comprising:

a light-transmitting lamp vessel accommodating an electrical element, a lamp cap provided with a projecting contact pin having an axis, said lamp cap physically contacting and being secured to the lamp vessel, an electric conductor connected to the electrical element and to the contact pin, an indentation being formed in the contact pin to fix the electric conductor, wherein the electric conductor in the contact pin does not extend beyond a boundary of the indentation that is furthest removed from the lamp cap.

2. A capped electric lamp comprising:

a light-transmitting lamp vessel accommodating an electrical element, a lamp cap provided with a projecting contact pin having an axis, said lamp cap being secured to the lamp vessel, an electric conductor connected to the electrical element and to the contact pin, an indentation being formed in the contact pin to fix the electric conductor, wherein the electric conductor in the contact pin does not extend beyond a boundary of the indentation that is farthest removed from the lamp cap, and wherein the indentation has a pinch portion near the boundary, said pinch portion serving to physically weaken the electric conductor to the extent that, during the manufacture of the electric lamp, upon a pulling of an end portion of the electric conductor, the electric conductor breaks at a predetermined position.

3. The capped electric lamp as claimed in claim 2, wherein the pinch portion deepens in the direction of the front boundary at an angle $\alpha$ ranging $10° \leqq \alpha \leqq 45°$, wherein the angle $\alpha$ is measured with respect to the axis.

4. The capped electric lamp as claimed in claim 3, wherein the pinch portion deepens at an angle in the range from $25° \leqq \alpha \leqq 35°$.

5. A capped electric lamp comprising:

a light-transmitting lamp vessel accommodating an electrical element;

a lamp cap provided with a projecting contact pin having an axis, said lamp cap being secured to the lamp vessel;

an electric conductor connected to the electrical element and to the contact pin; and an indentation being formed in the contact pin to fix the electric conductor;

wherein the electric conductor in the contact pin does not extend beyond a boundary of the indentation that is farthest removed from the lamp cap; and wherein the indentation comprises a press portion for fixing the electric conductor.

6. The capped electric lamp as claimed in claim 5, wherein the ratio of the depth $d_{pr}$ of the press portion to the diameter $d_{cp}$ of the contact pin meets the relation:

$$0.2 \leq \frac{d_{pr}}{d_{cp}} \leq 0.4.$$

7. A capped electric lamp comprising:

a light-transmitting lamp vessel accommodating an electrical element;

a lamp cap provided with a projecting contact pin having an axis, said lamp cap being secured to the lamp vessel;

an electric conductor connected to the electrical element and to the contact pin; and an indentation being formed in the contact pin to fix the electric conductor;

wherein the electric conductor in the contact pin does not extend beyond a boundary of the indentation that is farthest removed from the lamp cap; and wherein a length $l_{cl}$ of fixation of the electric conductor in the contact pin is at least 0.75 mm.

8. The capped electric lamp as claimed in claim 1, wherein the contact pin has only one indentation.

9. The capped electric lamp as claimed in claim 1, wherein the lamp has two lamp caps which are each provided with two contact pins.

10. A low-pressure mercury vapor discharge lamp comprising a capped electric lamp, said capped electric lamp comprising:

a light-transmitting lamp vessel accommodating an electrical element;

a lamp cap provided with a projecting contact pin having an axis, said lamp cap being secured to the lamp vessel;

an electric conductor connected to the electrical element and to the contact pin; and an indentation being formed in the contact pin to fix the electrical conductor;

wherein the electric conductor in the contact pin does not extend beyond a boundary of the indentation that is farthest removed from the lamp cap;

the lamp vessel enclosing a discharge space provided with a filling of mercury and an inert gas in a gastight manner, and the electric element comprising an electrode arranged in the discharge space for maintaining a discharge in said discharge space.

11. The capped electric lamp as claimed in claim 1, wherein the electric conductor is in electric contact between said indentation and a wall of said contact pin.

12. A capped electric lamp comprising a light-transmitting lamp vessel accommodating an electrical element, a lamp cap provided with a projecting contact pin having an axis, which lamp cap abuts and is secured to the lamp vessel, an electric conductor connected to the electrical element and to the contact pin, and a further electrical conductor connected to the electrical element, passing through the same lamp cap without being electrically connected to said electric conductor and contact pin, an indentation being formed in the contact pin to fix the electric conductor, wherein the electric conductor in the contact pin does not extend beyond a boundary of the indentation that is furthest removed from the lamp cap.

13. The capped electric lamp claimed in claim 12, wherein the indentation comprises a press portion for fixing the electric conductor.

14. The capped electric lamp claimed in claim 13, wherein the ratio of the depth $d_{pr}$ of the press portion to the diameter $d_{cp}$ of the contact pin meets the relation:

$$0.2 \leq \frac{d_{pr}}{d_{cp}} \leq 0.4.$$

15. The capped electric lamp claimed in claim 12, wherein the length $l_{cl}$ of the fixation of the electric conductor in the contact pin is at least 0.75 mm.

* * * * *